US005165491A

United States Patent [19]

Wilson

[11] Patent Number: 5,165,491

[45] Date of Patent: Nov. 24, 1992

[54] METHOD OF HORIZONTAL DRILLING

[75] Inventor: Gerald E. Wilson, Montgomery, Tex.

[73] Assignee: Prideco, Inc., Houston, Tex.

[21] Appl. No.: 692,620

[22] Filed: Apr. 29, 1991

[51] Int. Cl.[5] ..... E21B 7/04

[52] U.S. Cl. ..... 175/62; 175/73

[58] Field of Search ..... 175/62, 61, 73, 76, 175/320, 325

[56] References Cited

U.S. PATENT DOCUMENTS

| | | | |
|---|---|---|---|
| 3,326,581 | 6/1967 | Wong | 285/173 |
| 3,563,323 | 2/1971 | Edgecombe | 175/76 |
| 4,428,441 | 1/1984 | Dellinger | 175/61 |
| 4,431,068 | 2/1984 | Dellinger et al. | 175/61 |
| 4,484,641 | 11/1984 | Dismukes | 175/61 |
| 4,523,652 | 6/1985 | Schuh | 175/61 |
| 4,560,012 | 12/1985 | McNeely, Jr. | 175/61 |
| 4,577,701 | 3/1986 | Dellinger et al. | 175/61 |
| 4,627,502 | 12/1986 | Dismukes | 175/61 X |
| 4,629,012 | 12/1986 | Schuh | 175/75 |
| 4,674,580 | 6/1987 | Schuh et al. | 175/325 |
| 4,762,186 | 8/1988 | Dech et al. | 175/61 |
| 4,858,705 | 8/1989 | Thiery | 175/73 |
| 5,042,597 | 8/1991 | Rehm et al. | 175/62 X |

FOREIGN PATENT DOCUMENTS 3101060 7/1982 Fed. Rep. of Germany .

*Primary Examiner*—Terry Lee Melius

*Attorney, Agent, or Firm*—Vaden, Eickenroht, Thompson, Boulware & Feather

[57] ABSTRACT

A method is disclosed for drilling a well bore having a vertical portion, a curved kick-off portion, and a horizontal portion. The length of the horizontal portion is extended by using drill pipe having an aluminum tube and steel tool joints to reduce the weight of the pipe string in the horizontal portion and reduce the friction resisting movement of the drill pipe along the low side of the well bore. In addition, the length of the joints of aluminum drill pipe is reduced to between 14–16 feet to substantially increase the buckling strength of each joint.

2 Claims, 1 Drawing Sheet

METHOD OF HORIZONTAL DRILLING

This invention relates to a method of horizontal drilling where the horizontal well bore is located well below the surface of the earth in an oil and gas producing formation.

It is common practice today with respect to certain producing formations to drill a well bore vertically to about the top of the producing formation, kick the well bore off vertical about 90°, and drill horizontally as far as possible in the producing formation. The reason for this, of course, is to increase drainage of the reservoir into the well bore and increase production from the well. One area where this is commonly done these days is in the Austin chalk formation in Texas.

Obviously, it is advantageous to have the horizontal section of the well bore extend as far as possible. The bit will drill ahead as long as it is held against the formation with sufficient force. When drilling vertical well bores, thick walled pipe joints, called drill collars, are located just above the drill bit to supply the desired force on the bit, usually referred to as "weight-on-bit" (WOB). As the angle of the well bore changes from vertical to horizontal, the drill string is held against the lower wall of the well bore by gravity. Under these conditions, the portion of the drill string in the kickoff and horizontal portions of the well bore cannot exert any weight on the bit because all of its weight is exerted against the low side of the well bore and any force exerted on the drill bit must overcome the friction between the pipe and the low side of the well bore.

To reduce the friction between the drill pipe and the wall of the well bore in the curved and horizontal sections of the well bore, it is common practice these days to use conventional drill pipe in this section of the drill string and locate the drill collars that provide the weight to be transmitted to the bit in the vertical or near vertical section of the well bore. A joint of the drill pipe used in such an operation is about 30 ft. long. With this arrangement, the limiting factor now becomes the buckling strength of the drill pipe. For example, the force required to buckle 3½ 13.30 lbs. per foot steel drill pipe is about 41,000 lbs. Therefore, if it was desired to have 10,000 lbs. of force at the bit urging the bit to drill, there would be a little over 30,000 lbs. of force available to overcome the frictional force between the drill pipe and the well bore when the force exerted on the drill pipe is at or close to its buckling force.

This problem was partially overcome by Schuh et al as disclosed in U.S. Pat. No. 4,674,580, which issued Jan. 23, 1987. Since the buckling load for a joint of drill pipe is calculated as if each joint acts as a column in compression, then Euler's Formula can be used to determine the buckling load for the drill pipe. Schuh suggest that cylindrical stress sleeves be located on the pipe joint between the tool joints to in effect divide the pipe joint into a plurality of shorter individual columns rather than one 30 ft. column. Thus, each cylindrical stress sleeve acts as a tool joint to effectively shorten the length of the joints and increase their resistance to buckling. Specifically Schuh et al stated in column 5, beginning at line 5 et seq.

In accordance with the present invention, a length of standard pipe becomes a plurality of shorter lengths due to the spacing of sleeves 30 on pipe body 13. This gives the same effect as if the plurality of shorter lengths were joined together by tool joints which, itself, is impractical due to economic considerations.

Schuh et al are talking about steel drill pipe. They did not recognize that by using short (14–16 ft.) joints of aluminum drill pipe with steel tool joints for horizontal drilling, a satisfactory buckling resistant drill string is available and one that is substantially lighter. Being lighter, the string is able to transmit the required weight on the bit for a greater distance than the steel pipe and thus is able to drill longer horizontal well bores.

Further, Schuh et al were talking about the cost of adding three additional tool joints per 30 ft. joint. This is unnecessary. Reducing the length of a 30 ft. joint of aluminum drill pipe to about 15 feet provides ample rigidity (resistance to buckling) and by reducing the normal force between the pipe string and the low side of the well bore, the force required to overcome the friction between the pipe and the well bore is reduced substantially.

Therefore it is an object of this invention to provide a method of drilling the generally horizontal portion of a well bore having a generally vertical first portion, a kick-off second portion and a generally horizontal third portion using rotary drilling procedures with a drill string having a drill collar section located in the first portion and made up of a plurality of drill collars to provide the desired weight-on-bit and a drill pipe section made up of a plurality of joints of drill pipe, each joint being between 14–16 ft. long and having an aluminum tube section and steel tool joints attached to each end of the tube with an outside diameter larger than the aluminum tube in which the force required to buckle such aluminum pipe joints is at least equal to a standard range two joint of steel drill pipe of the same diameter.

This and other objects, advantages, and features of this invention will be apparent to those skilled in the art from a consideration of this specification including the attached drawings and appended claims.

IN THE DRAWINGS

Figures 1, 2:
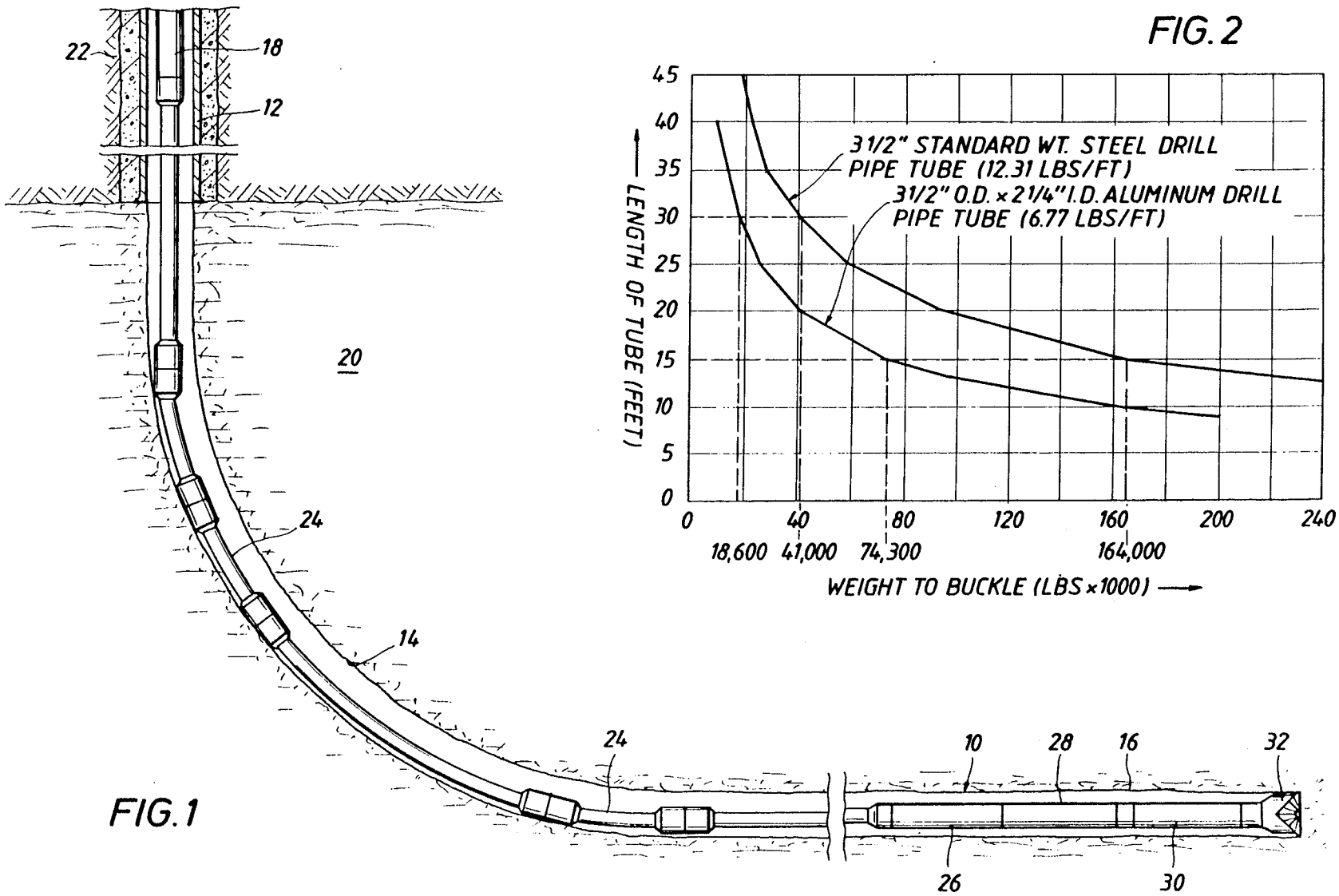
FIG. 1 is a schematic cross-section of the lower portion of a pipe string located in a well bore having a vertical portion, a curved kick-off portion, and a horizontal portion.
FIG. 2 is a graph showing the weight required to buckle various lengths of 3½" O.D. standard weight (12.31 lbs./ft.) steel drill pipe tubes and 3½ O.D. ×2¼" I.D. (6.77 lbs./ft.) aluminum drill pipe tubes.

In accordance with this invention, a method is disclosed of drilling the generally horizontal portion 10 of a well bore having a generally vertical first portion 12, a curved kick-off portion 14, and a generally horizontal third portion 16. The drill string for accomplishing this includes a plurality of drill collars 18 located in the vertical portion of the well bore. Often after drilling to the top of the producing formation 20, casing is set as shown in FIG. 1, where casing 22 is shown extending to the top of producing formation 22 where it is cemented in the well bore.

After the casing is set, kick-off portion 14 of the well bore is drilled using conventional methods until the well bore is headed in a generally horizontal direction. Depending upon the angle the formation makes with the horizontal, it may be desirable that this portion of the well bore follow the direction of the formation, which may or may not require this section of the well bore to be horizontal. It could be several degrees off in either direction. Sometimes, the well is kicked off above the producing zone and casing is then set through a portion of the radius into the producing zone. Then the radius is finished and the horizontal section is drilled.

At the time that the horizontal portion of the well bore is being drilled, as explained above, the drill string is made up of drill collars 18 located in the vertical section of the well bore 12. Below that, the drill string is made up of aluminum tubes having steel tool joints attached to each end, hereinafter aluminum pipe joints or aluminum drill pipe 24. The aluminum pipe joints are approximately 14 to 16 ft. long. At the lower end of the drill string is attached a M.W.D. (measurement while drilling) tool 26, non-magnetic drill collar 28, downhole motor 30, and drill bit 32. The use of a downhole motor and M.W.D. tool is optional. There are advantages to their use, however. The downhole motor eliminates the need to rotate the drill pipe. With a bent sub and the M.W.D. tool, the direction of the hole can be changed without making a trip.

The buckling strength of this string of approximately 15 ft. aluminum drill pipe is increased from 18,582 lbs. for 30 ft. joints of aluminum drill pipe to 74,330 lbs. for 15 ft. joints. This is nearly twice the buckling strength of the tube of 30 ft. 3½", standard weight steel drill pipe. In addition, the weight of the string is reduced approximately 132 lbs. per 30 feet equivalent length. Therefore, 3,000 ft. (200 joints) of 15 ft. aluminum joints will be 13,000 lbs. less than the same length (100 joints) of 3½" 13.30 lbs. per foot steel drill pipe. At 6,000 ft. the weight difference is 26,000 lbs. Such a reduction in weight should increase the distance that the horizontal portion of the well bore can be drilled into the formation, which should increase the rate of production from the well.

From the foregoing it will be seen that this invention is one well adapted to attain all of the ends and objects hereinabove set forth, together with other advantages that are obvious and inherent in the method.

What is claimed is:

1. A method of drilling the generally horizontal portion of a well bore having a generally vertical first portion, a kickoff second portion, and a generally horizontal third portion, using rotary drilling procedures with a drill string having a drill collar section located in the first portion to provide the desired weight-on-bit and a drill pipe section made up of a plurality of joints of drill pipe each joint being between 14–16 feet long and having an aluminum tube section and steel tool joints attached at each end of the tube, the method comprising rotating the drill bit and applying the desired weight-on-bit by lowering the pipe string to transfer a portion of the weight of the drill collars to the drill bit through the drill pipe placing the drill pipe in compression and forcing the tool joints against the low side of the well bore where the frictional force between the tool joints and the low side of the well bore is less than for steel drill pipe due to the reduction in the normal force between the tool joints and the well bore while the force required to buckle the pipe joints is at least equal to range 2 steel drill pipe of the same diameter.

2. A method of horizontal drilling of a well bore in the earth's crust using rotary drilling procedures wherein a drill string including drill collars and drill pipe is used to advance a drill bit attached to the drill pipe at the lower end of the drill string into the earth and form a well bore, comprising drilling a first portion of the well bore from the surface to a kick-off point, the well bore being sufficiently close to vertical for drill collars located in the first portion to provide sufficient weight-on-the-bit for effective drilling, gradually changing the direction of the drill bit at the kick-off point until the bit is drilling at an angle to the vertical such that substantially all of the weight-on-bit is supplied by the drill collars in the vertical first portion of the well bore and the drill pipe in the kick-off portion of the well bore is in compression, continuing to rotate and apply weight on the bit to drill a substantially horizontal well bore away from the kick-off point using drill pipe made up of a plurality of pipe joints each joint comprising an aluminum tube with steel tool joints on each end and a length between 14–16 feet to allow the length of the horizontal well bore to be increased due to the reduction in the weight of the drill pipe and an increase in the buckling strength of each joint.

* * * * *